United States Patent [19]

Derrick

[11] Patent Number: 4,637,468

[45] Date of Patent: Jan. 20, 1987

[54] METHOD AND APPARATUS FOR MULTIZONE OIL AND GAS PRODUCTION

[76] Inventor: John M. Derrick, P.O. Box 396, Giddings, Tex. 78942

[21] Appl. No.: 771,588

[22] Filed: Sep. 3, 1985

[51] Int. Cl.[4] ..... E21B 43/14

[52] U.S. Cl. ..... 166/297; 166/55.1; 166/133; 166/151; 166/311; 166/313; 166/325

[58] Field of Search ..... 166/313, 297, 369, 370, 166/373, 133, 188, 151, 184, 193, 113–115, 327, 328, 325, 54.1, 55.1, 308, 311

[56] References Cited

U.S. PATENT DOCUMENTS

| | | | |
|---|---|---|---|
| 2,246,811 | 6/1941 | Otis | 166/325 |
| 2,847,072 | 8/1958 | Lebourg | 166/114 |
| 2,935,131 | 5/1960 | McCune | 166/297 |
| 2,986,216 | 5/1961 | McCulloch | 166/114 |
| 3,371,717 | 3/1968 | Chenoweth | 166/325 |
| 3,381,753 | 5/1968 | Fredd | 166/325 |
| 3,735,815 | 5/1973 | Myers | 166/313 |
| 3,952,804 | 4/1976 | Smyrl | 166/313 |

*Primary Examiner*—James A. Leppink
*Assistant Examiner*—Hoang C. Dang
*Attorney, Agent, or Firm*—Neal J. Mosely

[57] ABSTRACT

A lower formation of a multizone well is perforated by a perforating gun lowered by wireline, and then fractured. A packer (modified Pengo packer) with a central bore and a valve seat is positioned within the casing between the lower and upper formations. A plug is set into the packer valve seat by a perforating gun and released by shearing a shear pin. The well is pressurized to maintain the plug in the valve seat, the perforating gun raised, and the casing opposite the upper formation perforated. The gun is removed, and the upper formation fractured. After a suitable flow-back period, another packer is then positioned in the casing above the upper perforated formation. The pressure differential between formations maintains the plug seated, allowing the upper formation to be produced. When a change in pressure differential raises the plug off the valve seat, the lower formation may be produced. After pressures in the formations have equalized, the plug is removed by a retrieving tool constructed to permit simultaneous bailing of sand and grappling of the tool. After retrieval of the tool, the formations may be produced by conventional mechanical lift methods.

17 Claims, 11 Drawing Figures

METHOD AND APPARATUS FOR MULTIZONE OIL AND GAS PRODUCTION

BACKGROUND OF THE INVENTION

1. Field of the Invention

This invention relates generally to methods and apparatus for producing hydrocarbons from vertically spaced productive zones, more particularly to a method and apparatus for isolating the producing formations with a packer having a movable plug set in a valve seat by a perforating gun prior to fracturing the upper formation. The plug is movable responsive to the pressure differential between the upper and lower formations allowing alternating production of the formation having the greater pressure. The plug is removed by a retrieving tool having an internal piston and check valve which displaces sand accumulated above the plug by drawing sand thereinto to expose the top of the plug to a grapple element of the retrieving tool.

2. Brief Description of the Prior Art

When a cased well penetrates a plurality of separate productive zones, such as two or more zones, and the casing is to be perforated opposite each of the zones, the pressure differential between the two zones makes it imperative that the production from the two zones be isolated from each other at all times. These techniques are well described in the literature.

In many oil fields, it is desirable to produce from two different zones simultaneously. The two zones are often of different pressures, and one may produce gas, the other oil. Simultaneous separate production of the two zones is commonly accomplished through the tubing and through the space between the tubing and the casing.

There are several patents which disclose methods and apparatus for use in multizone wells for the production of hydrocarbons.

Schell et al, U.S. Pat. No. 3,289,762 discloses a method of multiple fracturing well formations wherein a ball is dropped down a string of tubing having a baffle (ball seat) in the string that is positioned between an upper and lower formation and a perforated anchor pipe at the bottom. The lower formation is perforated then fractured by increasing the pressure in the fracturing fluid causing an enlargement in the fracture. The ball is dropped down the tubing and lodges in the baffle to isolate the fracture in the lower formation from the fluid pressure above the baffle. The upper formation is perforated and the well pressure increased to perforate and fracture the upper formation. When the upper formation has been fractured, the fluid from the formations carries the ball to the top of the tubing. The fluid then flows from both formations simultaneously.

Lebourg, U.S. Pat. No. 2,847,072 discloses a method for dual completion of wells. A production packer is set in the well casing between the formations to be produced and tubing is set in the well with the lower end thereof above the upper formation. The upper and lower formations are then respectively perforated, leaving the tubing end open. A tubing extension that passes through the production packer is connected to the tubing to establish communication between the lower formation and the tubing. The two formations are effectively separated by the production packer after the tubing extension has been passed therethrough. The lower formation is produced through the tubing extension and simultaneously the upper formation is produced separately through the space between the casing and the tubing.

Reistle, Jr., U.S. Pat. No. 2,769,497 discloses a method for treating a plurality of well formations. A movable tubing string having a packer at its lower end is run into a casing cemented in the well. The packer resists flow downwardly in the casing-tubing annulus. The assembly is positioned above the formations while a perforator is run through the assembly and the casing is perforated opposite the desired formation. The tubing-packer assembly is moved downward below the perforated formations and the formations are fractured by increasing the pressure in the fracturing fluid causing an enlargement in the fracture. After the upper formation has been fractured, the tubing-packer assembly is moved upwardly so that the bottom end of the tubing is above the upper perforated formation. Production may be obtained simultaneously or sequentially from the upper and lower formations by moving the packer relative to the formations to be produced or replacing the packer with a downwardly facing cup packer.

McCulloch, U.S. Pat. No. 2,986,216 discloses apparatus for use in wells completed in a plurality of zones. A tubing is arranged in the casing with its open lower end permanently placed above the upper of the zones. A mandrel is attached to and forms the lower end of the tubing. A first packer is arranged on the lower end of the mandrel closing off the casing-tubing annulus, and a second packer having an open bore is arranged below the lower end of the mandrel to separate the upper and lower zones. The upper portion of a tubular member forms a piston slidably mounted in the mandrel and its lower end is is provided with seals for placement in the open bore of the second packer. By applying fluid pressure down the tubing to the piston, the tubular member is moved from a first position in the mandrel to a second extended position whereby its lower end is sealed in the open bore of the second packer. A first flow path is provided through the tubular member and tubing in the lower zone to the earth surface and a second flow path from the upper zone through a port in the mandrel or through a second tubing string having its lower end above the upper of the plurality of zones.

McCune, U.S. Pat. No. 2,935,131 discloses a method and apparatus for completing a well in a plurality of zones. A packer assembly is positioned within a casing which penetrates two spaced apart productive formations. A production tube positioned in the packer extends above and below the packer and the lower end terminates above the lower formation. A second packer is installed on the tubing string above the upper formation. The system requires numerous trips in and out of the well during perforating operations to connect and disconnect a tubing string to the production tube, and to install, test, and remove port closing members in a landing landing recess inside a coupling connected to the upper end of the production tube, and to install and remove flow separation tools in a side port landing nipple. In production, the well is now allowed to produce from both formations with fluid from the lower formation flowing into the casing, below the lower packer, through the production tube, tubing, and out through the ports of the side port nipple, and up through the tubing casing annulus above the upper packer. The production fluids from the upper formation flow into the annulus between the two packers and through the smaller pipe and into the tubing above the modified separation tool.

Bielstein, U.S. Pat. No. 3,032,108 discloses a packer apparatus which provides for selectively producing single or multiple completion wells. The apparatus comprises spaced apart packer elements interconnected by tie rod members. The upper packer is connected to a pipe string and the lower packer is mounted on a tubular member. The tie rods have upper and lower collars which are connected to flanges attached by shear pins on the pipe and tubing members. The pipe string may be provided with a landing nipple for supporting tubular extensions and a closable port positioned below the landing nipple for permitting fluid flow between the pipe string and the annulus between the casing and pipe string. In operation, the packer elements are set astride the formations to be perforated and a perforating gun is lowered through the pipe string and tubular member to perforate the lower formation of a cased well and then removed. A plug is lowered by wireline into position and latched in the lower packer and a perforating gun is lowered through the pipe string to a position adjacent the upper formation (between the two packer elements) to perforate the upper formation. A tubular extension having a latching mechanism and sealing means is supported in the pipe string. The tubular extension extends through the lower packer and is provided with additional sealing means for sealing off the annulus between the lower tubular member and the tubular extension. Production fluids from the lower formation flow upwardly through the tubular extension and pipe string whereas production fluids from the upper formation flow through the annulus between the packer elements, into the pipe string, and out through the closable port, and to the earth surface through the tubing casing annulus.

These patents in particular and the prior art in general do not disclose the present method and apparatus whereby a two way packer having a central bore and a valve seat is positioned within the casing between a perforated lower formation and an upper formation after which a plug is set into the packer valve seat by a perforating gun and released by shearing a shear pin. The well is pressurized to maintain the plug in the valve seat, the perforating gun is raised, and the casing opposite the upper formation is perforated. The gun is removed, and the upper formation is fractured by conventional methods. Another packer is then positioned in the casing above the upper perforated formation.

The plug is movable responsive to the pressure differential between the upper and lower formations, such that greater well pressure above the plug will maintain the plug in the valve seat allowing the upper formation to be produced and greater pressure below the plug will raise the plug off the valve seat allowing the lower formation to be produced. After the pressure in each formation has equalized, the plug is removed by a retrieving tool having an internal piston and check valve which displaces sand accumulated above the plug by drawing sand thereinto to expose the top of the plug to a grapple element of the retrieving tool. The formations may then be produced by conventional mechanical lift methods.

SUMMARY OF THE INVENTION

It is therefore an object of the present invention to provide a method and apparatus for isolating the productive zones in a multizone well.

Another object of this invention is to proivde a method and apparatus utilizing the pressure differential between two or more productive zones for the manipulation of the apparatus to alternatly produce from the zone having the greatest pressure.

Another object of this invention is to provide a method and apparatus for producing multizone wells which requires a minimum of time, reduces expense and equipment, and trips into the well.

Another object of this invention is to provide a apparatus which is simple in construction, inexpensive to manufacture, and rugged and durable in use.

Another object of this invention is to provide a method and apparatus for removing a line plug and bailing sand from a well at the same time.

Other objects of the invention will become apparent from time to time throughout the specification and claims as hereinafter related.

The above noted objects and other objects of the invention are accomplished by perforating the lower casing of a multizone well opposite the lower formation by lowering a perforating gun into the casing by wireline, and then fracturing by conventional methods. A modified packer having a central bore and a valve seat is positioned within the casing between the lower and upper formations. A plug is set into the packer valve seat by a perforating gun and released by shearing a shear pin. The well is pressurized to insure to maintain the plug in the valve seat, the perforating gun is raised, and the casing opposite the upper formation is perforated. The gun is removed, and the upper formation fractured by conventional methods. After the usual flow-back period, another packer is then positioned in the casing above the upper perforated formation and the plug can be retrieved.

The plug is movable by the pressure differential between the upper and lower formations, such that greater well pressure above the plug will maintain the plug in the valve seat allowing the upper formation to be produced and greater pressure below the plug will raise the plug off the valve seat allowing the lower formation to be produced. After the pressure in each formation has equalized, the plug is removed by a retrieving tool, run on a wireline, having an internal piston and check valve which displaces sand accumulated above the plug by drawing sand thereinto to expose the top of the plug to a grapple element of the retrieving tool. The formations may then be produced by conventional mechanical lift methods.

DESCRIPTION OF THE PREFERRED METHOD

Referring to FIGS. 1 through 6 by numerals of reference, a well bore with cemented casing 10 has penetrated two spaced apart productive formations or zones A and B. For reasons of clarity, the conventional casing cement has been omitted from the drawings.

Figure 1:
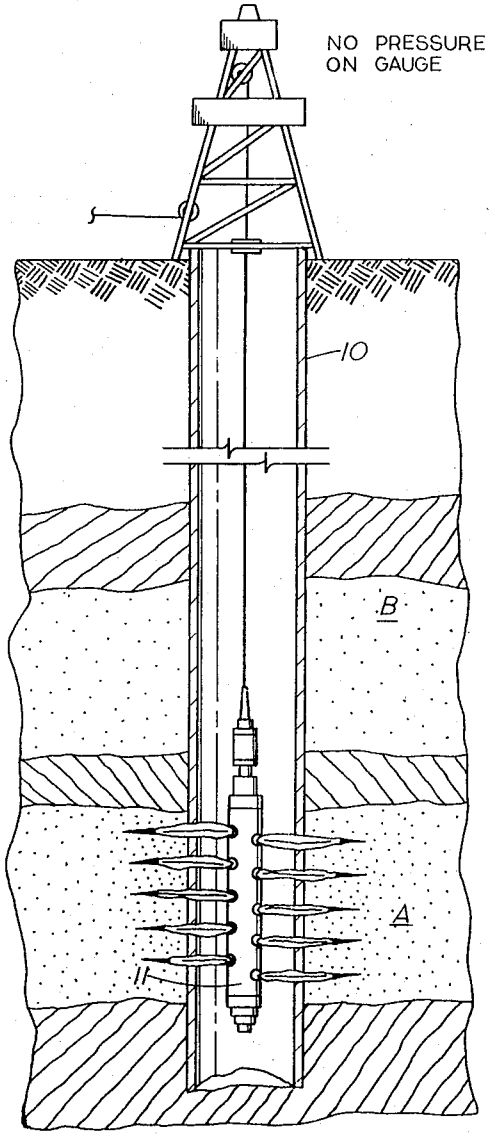
FIGS. 1 through 6 are schematic illustrations showing various steps and apparatus used in performing the method of the the present invention.
Figure 2:
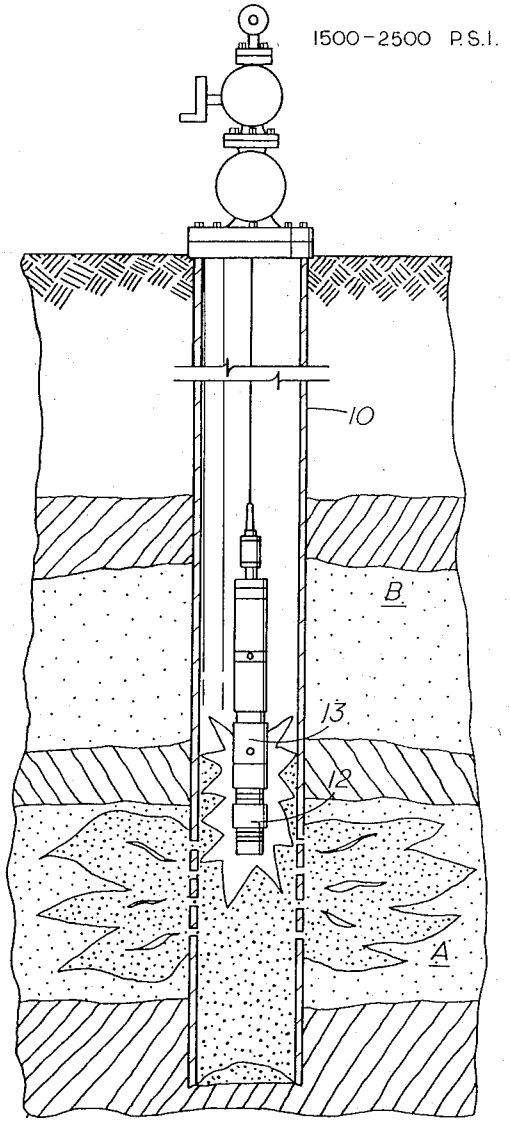

As shown in FIG. 1, the casing opposite zone A is perforated by a perforating gun 11 which has been lowered into the casing 10 on a wireline. The perforating gun 11 is then removed and zone A may be acidized and fractured.

Figure 3:
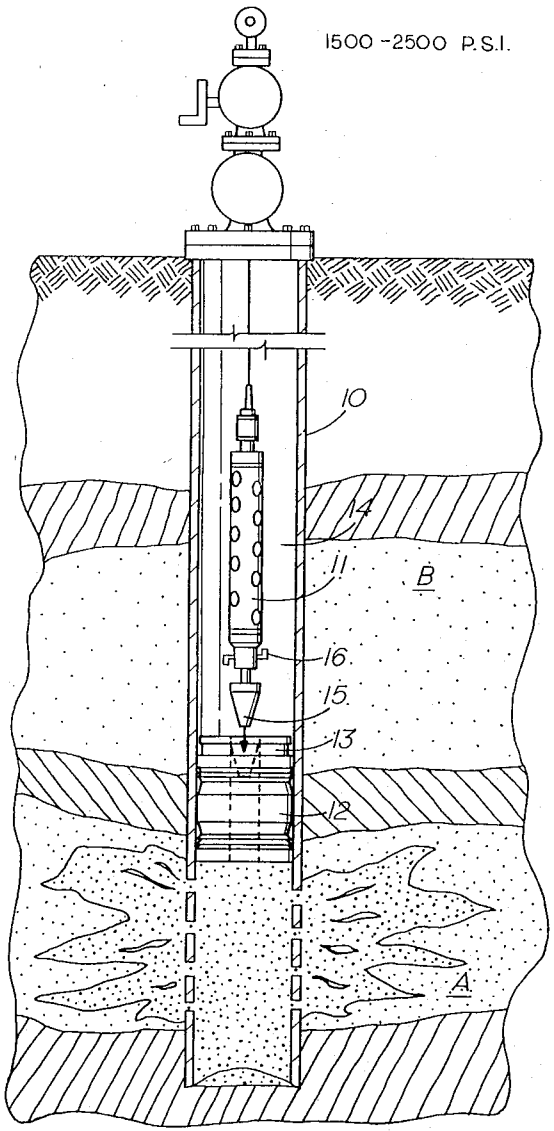

A packer 12 is lowered into the casing by wireline (FIG. 2) and set in a conventional manner between the zones A and B, as shown in FIG. 3. The packer 12 has a valve seat 13 in its top end which is described in greater detail below. A setting tool assembly 14 comprising a perforating gun 11, having a bomb or plug 15 releasably attached to the bottom by means of a shear pin 16, is lowered into the casing 10. The plug 15 is received in the valve seat 13 and the weight of the perforating gun 11 will shear the pin 16.

Figure 4:
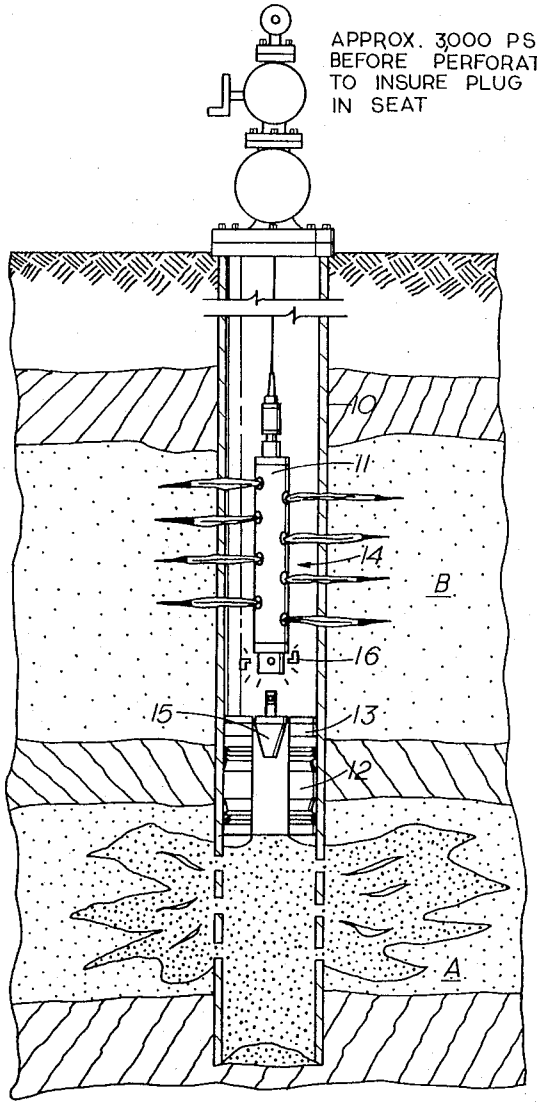

As shown in FIG. 4, after the pin 16 has been sheared, the well is pressurized to a suitable pressure, e.g., 3,000 psi, to maintain the plug 15 in the seat 13 and the perforating gun 11 is raised in the casing 10 to a position opposite the zone B. The casing opposite zone B is then perforated by the perforating gun 11 while the well is being pressurized. Zone B may then be acidized and fractured.

Figure 5:
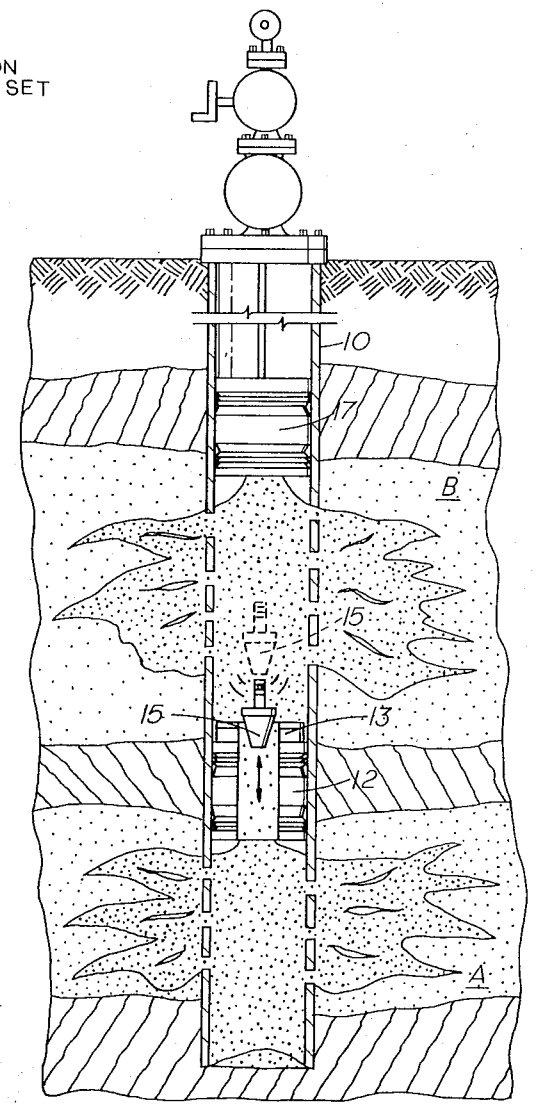

After zone B has been perforated and flowed back for 6–7 days, a conventional production packer 17 is lowered and set in the casing 10 above the perforated zone B (FIG. 5). The plug may be retrieved or set in place. After the last fracturing job, the well is allowed to set for 24 hours, after which the well is ready to be produced.

In production, if the pressure of zone B is greater than zone A, the pressure from zone B will maintain the plug 15 in the valve seat 13 of the packer 12 while zone B is being produced. When the pressure in zone B falls below that of zone A, the pressure from zone A will raise the plug 15 off the valve seat 13 allowing zone A to be produced. When the pressure in zone A falls below that of zone B, the greater pressure of zone B forces the plug 15 back down onto the valve seat 13. After the well has equalized, the plug 14 and sand is removed by a retrieving tool 18 (described hereinafter) so that both zones can be produced by conventional mechanical lift methods.

Figure 6:
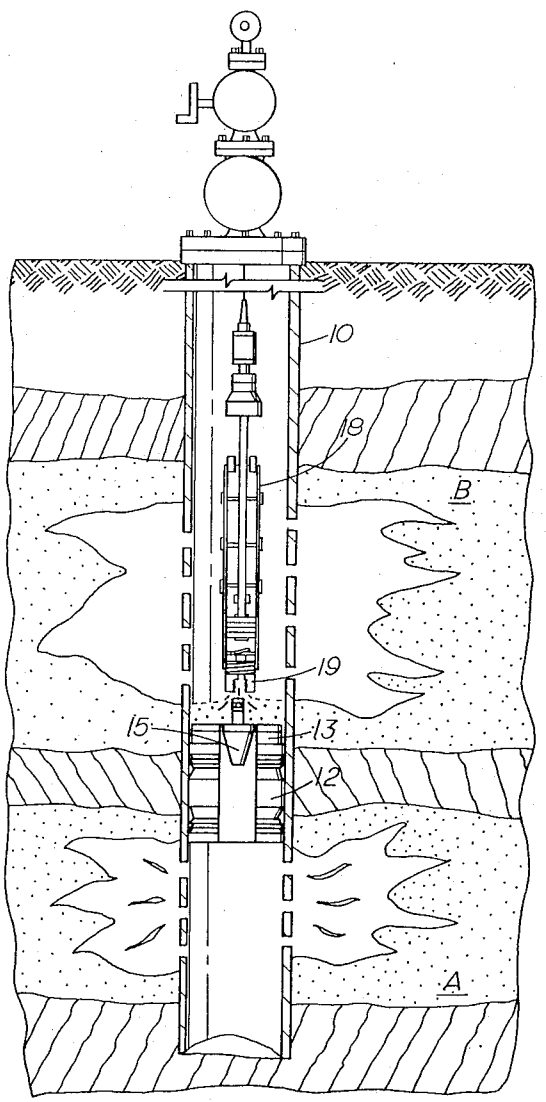

FIG. 6 shows the plug 15 being retrieved by a retrieving tool 18 having a grapple 19 at its lower end which attaches to the top of the plug. The retrieving tool 18 contains a reciprocating piston (described hereinafter) which allows the tool to "eat" or displace its way through sand and debris which may have accumulated above the plug.

Although the method of this invention has been described for producing two formations, more than two formations may be produced by repeating the steps.

DESCRIPTION OF THE PREFERRED EMBODIMENT

Figure 7A:
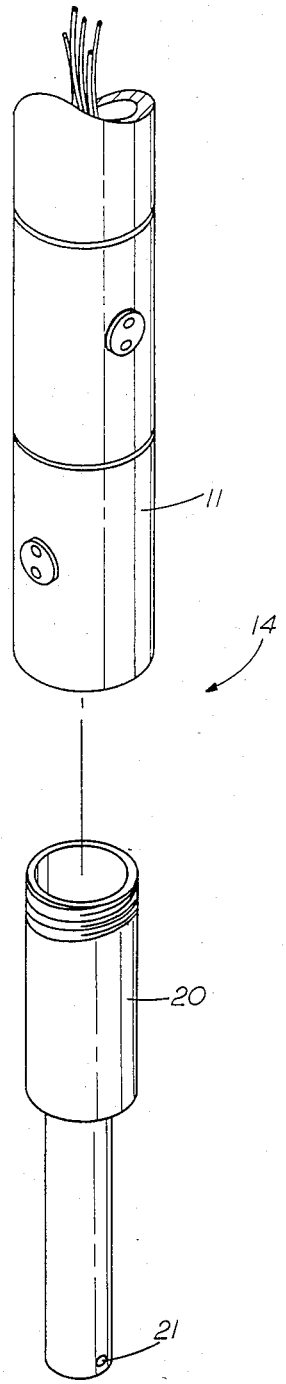
FIGS. 7A and 7B are exploded isometric views which in combination show the plug setting tool assembly, plug, and packer components used to set the plug in the packer.
Figure 7B:
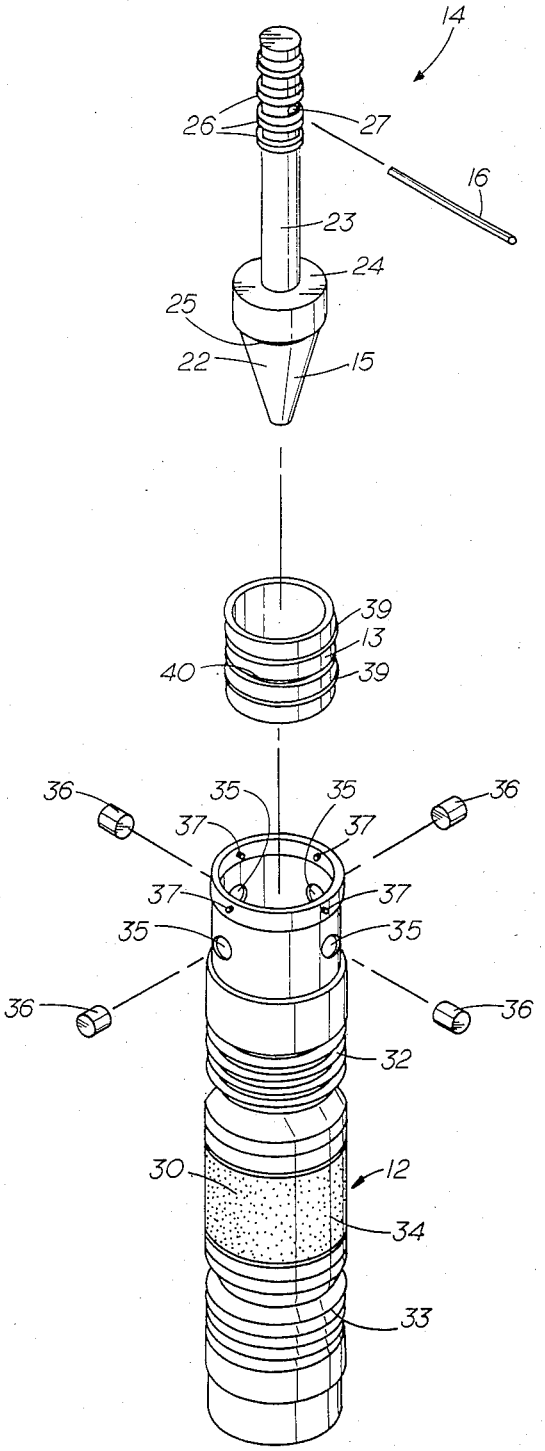
Figure 8:
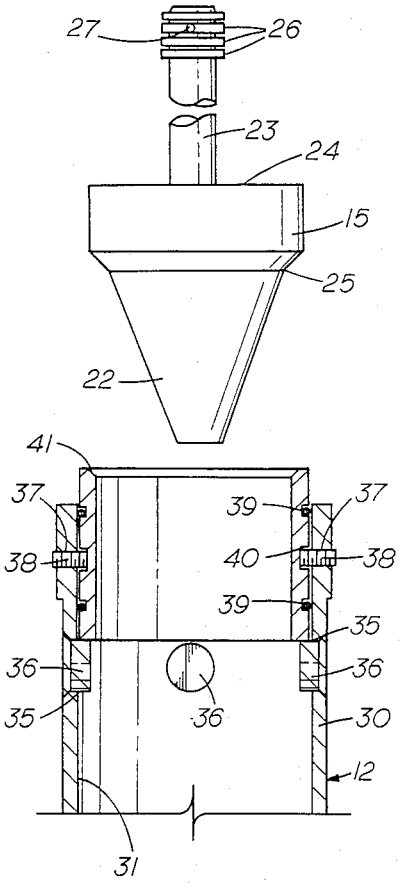
FIG. 8 is side elevational view in cross section of the upper portion of the packer component having a valve seat installed therein.

Referring now to FIGS. 7A, 7B, and 8, there is shown in greater detail the plug setting tool assembly 14, plug 15, and packer 12. The setting tool assembly 14 is used to set the plug 15 in the valve seat 13 of the packer 12. The upper portion of the assembly 14 comprises a perforating gun 11 having internal threads (not shown) in its lower portion which receive the threaded upper portion of a bull plug 20. A hole 21 extends transversly through the lower portion of the bull plug 20 to receive a shear pin 16.

The plug 15 comprises a cylindrical member having a conical shaped lower portion 22 and a reduced diameter upper portion 23 defining a shoulder 24 therebetween. An annular beveled seating surface 25 is formed at the top of the conical lower portion 22. The top portion of the plug 15 has a series of vertically spaced annular ribs 26 which protrude beyond the reduced diameter portion 23. A hole 27 extends transversly through the upper portion 23 in axial alignment with the hole 21 of the bull plug 20. When assembled, the upper portion 23 of the plug 15 is slidably received within the lower portion of the bull plug 20 and pinned with shear pin 16.

As shown in FIGS. 7B and 8, a cylindrical packer 12 comprises a cylindrical housing 30 having a central bore 31 and opposing expandable gripping members 32 and 33 and seal 34 on its outer circumference. The housing 30, gripping members 32 and 33, and seal 34 are conventional in the art and therefore not shown in detail. The grippers are of the type which set the packer to resist upward and downward movement. The internal upper portion of the housing 30 has a series of circumferentially spaced apertures 35 through the side wall a distance below the the top surface. A series of short cylindrical plugs 36 are secured within the apertures 35 such as by welding and the inward ends terminate inwardly of the central bore 31 to form a stop for the valve seat 13. A series of circumferentially spaced threaded apertures 37 extend through the side wall of the housing 30 above the plugs 36 and receive set screws 38.

A cylindrical valve seat member 13 is slidably received within the upper portion of the packer housing 30 and supported on the plugs 37. A pair of vertically spaced annular seals 39 are provided on the circumference of the seat member 13 to seal on the central bore 31 of the packer 12. An annular groove 40 is formed on the circumference of the seat member 13 intermediate the seals 39 which receive the ends of the set screws 38 to removably retain the seat member in the top of the housing 30. The top of the seat member 13 has a beveled seating surface 41 which corresponds to the beveled surface 25 of the plug 15.

Figure 9A:
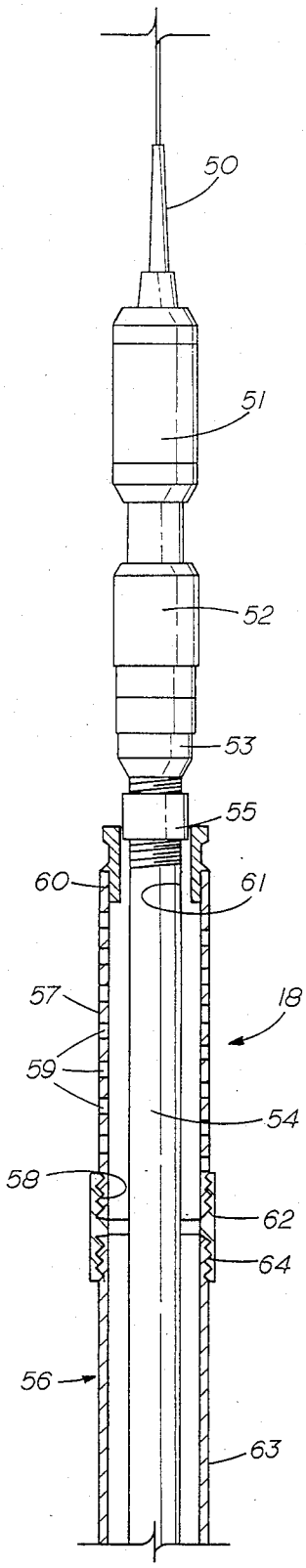
FIGS. 9A and 9B are side elevational views which in combination show the fishing tool which retrieves the plug from the packer.
Figure 9B:
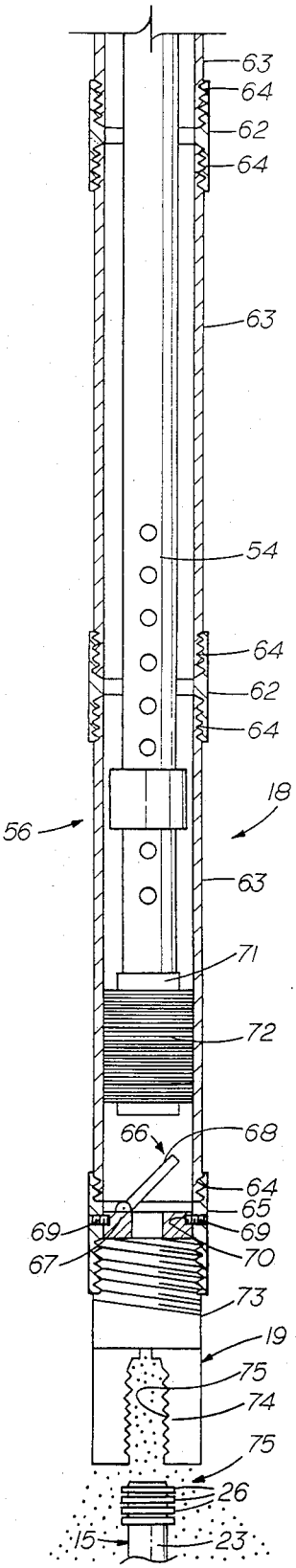

FIGS. 9A and 9B illustrate the retrieving tool assembly 18 which is used to remove the plug 15 from the packer 12. The assembly 18 comprises an elongated tubular structure which is attached to a wireline by a conventional wireline connector 50 at the top end. A conventional collar locator 51, quick change coupling 52, and reducing sub 53 are connected to the top of a section of line pipe 54 by a collar 55. The lower portion of the line pipe 54 below the collar 55 depends downwardly from the collar and is reciprocally received within an elongated outer housing 56. Line pipe 54 may have apertures and a centralizing collar to facilitate movement within the outer housing.

The outer housing 56 comprises a cylindrical sub 57 having an externally threaded bottom 58 and a plurality of perforations 59 in its side wall. A flat circular plate 60 having a central bore 61 is secured such as by welding to the interior of the sub 57 near the top end. The line pipe 54 is slidably received through the central bore 61. The perforated sub 57 is secured by a collar 62 to the top of a section of tubing 63 having external threads 64 at each end. Several other sections of tubing 63 having externally threaded ends 64 are connected below the first tubing by collars 62.

A valve collar 65 having internal threads at each end is connected to the bottom of the lowermost setion of tubing 63. A flapper valve assembly 66 comprising a cylindrical valve seat 67 having a valve flapper 68 mounted thereon is removably secured within the valve collar 65 intermediate the threaded ends by circumferentially spaced set screws 69 extending through the collar side wall which are received in apertures 70 in the circumference of the valve seat 67.

A piston 71 is attached at the lower end of the line pipe 54 and has bushings 72 which reciprocally seal on the interior surface of the tubing 63. When the retrieving tool assembly 18 is being lowered on the wireline, the piston 71 is near the bottom of the lowermost section of tubing 63.

A conventional grapple member 19 having a threaded upper portion 73 is connected to the valve collar 65 below the lowermost section of tubing 63. The bottom of the grapple 19 has a series of expandable depending fingers 74 having internal notches 75 on their inner surfaces which engage the ribs 26 of the plug 15 upon sufficient downward force.

In the event that sand 75 becomes built up around the plug 15, the retrieving tool assembly 18 may be lowered by wireline to rest at the top of the layer of sand 75. The line pipe 54 is lifted slowly sucking sand 75 through the flapper valve assembly 66 and into the interior of the lowermost section of tubing 63, until enough sand has been displaced to allow the grapple 19 to engage the top of the plug 15. In this manner, the retrieving tool assembly 18 effectively "eats" or displaces its way through the sand to reach the plug 15.

OPERATION

The casing opposite the lower formation is perforated by a perforating gun lowered into the casing by wireline. The perforating gun is removed and the lower formation may be acidized and fractured by conventional methods.

A packer having a central bore and a valve seat in is upper end is lowered into the casing by wireline and set in a conventional manner between the perforated lower formation and the upper formation.

The plug is attached to the bottom of the perforating gun by a shear pin to form the setting tool assembly, and the assembly is lowered into the casing. The plug is received in the valve seat of the packer and the weight of the perforating gun shears the shear pin.

After the pin has been sheared, the well is pressurized to a suitable pressure such as 3,000 psi to maintain the plug in the valve seat and the perforating gun is raised in the casing to a position opposite the upper formation. The casing opposite the upper formation is then perforated by the perforating gun while the well is being pressurized. The upper zone may then be acidized and fractured by conventional methods.

After the upper formation has been perforated, a conventional production packer is lowered and set in the casing above the perforated upper formation. After the last fracturing job, after 2–7 days, then the upper packer is set and the well is ready to be produced.

In production, if the pressure of the upper formation is greater than the lower, the pressure from the upper formation will maintain the plug in the valve seat of the packer while the upper formation is being produced. When the pressure in the upper formation is less than the lower, the pressure from the lower formation will raise the plug off the valve seat allowing the lower formation to be produced. When the pressure in the lower formation is less than the upper, the greater pressure of the upper formation forces the plug back down onto the valve seat. After the well has equalized, the plug is removed by a retrieving tool so that both zones can be produced by conventional mechanical lift methods.

The plug is retrieved by a retrieving tool having a grapple at its lower end which attaches to the top of the plug. The retrieving tool contains a reciprocating piston and flapper valve which allows the tool to "eat" its way through sand and debris which may have accumulated above the plug. When the retrieving tool assembly is being lowered on the wireline, the piston is near the bottom of the lowermost section of tubing. The retrieving tool assembly is lowered by wireline to rest at the top of the layer of sand. The line pipe is lifted slowly thereby sucking sand through the flapper valve and into the interior of the lowermost section of tubing, until enough sand has been displaced to allow the grapple to engage the top of the plug.

While this invention has been described fully and completely with special emphasis upon a preferred embodiment, it should be understood that within the scope of the appended claims the invention may be practiced otherwise than as specifically described herein.

I claim:

1. A method for producing an upper formation and a lower formation in a well comprising;

penetrating said upper and lower formations with a casing, cementing said casing in said well, perforating said casing adjacent to said lower formation, setting a first packer with a valve seat in said casing between said upper and lower formations, lowering a setting tool assembly comprising a perforating gun having a plug releasably attached thereto into said casing, setting said plug into said packer valve seat, releasing said plug from said perforating gun, pressuring said well sufficient to maintain said plug in said valve seat, perforating said casing adjacent to said upper formation, setting a second packer in said casing above said upper formation, said plug being vertically movable relative to said valve seat by differential pressure between said upper and lower formations to allow said upper formation to be produced when said plug is closed and said lower formation to be produced when said plug is open, and removing said plug from said well after the pressure in each formation has equalized allowing both formations to be produced by mechanical lift.

2. A method according to claim 1 including removing said perforating gun and fracturing said lower formation after perforating said casing adjacent to said lower formation, raising said perforating gun to a position opposite said upper formation, removing said perforating gun and fracturing said upper formation after perforating said casing adjacent to said upper formation, perforating said casing adjacent to said upper formation.

3. A method according to claim 2 including removing said plug by a retrieving tool which displaces sand accumulated above said plug by drawing the sand thereinto to expose the top of said plug.

4. A method according to claim 2 including removing said plug by a retrieving tool which contains a reciprocating piston member, a check valve member therebelow, and a grapple member at its bottom end, to displace sand accumulated above said plug by drawing the sand thereinto to expose the top of said plug, said piston being at its lowermost position when said retrieving tool assembly is lowered to rest at the top of the layer of accumulated sand and thereafter lifted to draw sand through said check valve and into the interior of said tool until enough sand has been displaced to allow said grapple to engage the top of said plug.

5. A method according to claim 2 in which said setting tool has said plug releasably attached to the bottom portion thereof by means of a shear pin, and shearing said shear pin by application of the weight of said perforating gun on said plug after setting in said packer valve seat.

6. A method according to claim 2 in which said well is allowed to set for 24 hours after the last fracturing job, before production is commenced.

7. A method according to claim 1 including closing in said well for about 6–7 days and permitting flowback for about 24 hours, then removing said plug.

8. Apparatus for producing a cased well penetrating a plurality of vertically spaced productive formations comprising;

first packer means adapted to be positioned within said casing of said well between lower and upper formations, said packer having a central bore and a valve seat therein for receiving a movable and retrievable bore closure member, said packer means having circumferential gripping means and sealing means for effectively gripping and sealing on the interior surface of said well casing to resist both upward and downward forces, a setting tool and perforating gun assembly having connecting means at its upper end for connection to a wireline and connecting means at its lower end for releasably attaching a bore closure member, and a movable and retrievable bore closure member releasably attached to and carried by said setting tool and perforating gun assembly and releasable therefrom to be operatively received within said packer valve seat to close the central bore, said bore closure member being vertically movable relative to said valve seat by differential pressure between said upper and lower formations to permit a selected formation to be produced according to whether said valve seat is open or closed.

9. Apparatus according to claim 8 in which said setting tool and perforating gun assembly comprises a perforating gun having connecting means at its upper end for connection to a wireline and connecting means at its lower end for receiving a bull plug, a bull plug member having its upper end connected to the lower end of said gun and a transverse hole in its lower portion for receiving a shear pin, said movable and retrievable bore closure member comprises a cylindrical plug member having a conical shaped lower portion and a reduced diameter upper portion, an annular beveled seating surface formed at the top of said conical lower portion for sealing on said packer valve seat, said upper portion being received within said lower portion of said bull plug and provided with a transverse hole in axial alignment with said hole in said bull plug for receiving said shear pin to pin said closure member to said bull plug.

10. Apparatus according to claim 9 in which said movable and retrievable bore closure member upper portion has means for receiving and engaging a retrieving tool.

11. Apparatus according to claim 10 in which said receiving and engaging means comprise a series of vertically spaced annular ribs protruding beyond said reduced diameter portion.

12. Apparatus according to claim 8 in which said first packer comprises a cylindrical housing having a central bore and opposing expandable gripping members and a sealing element on its outer circumference which allow said packer to be set on the side from forces above and below said packer.

13. Apparatus according to claim 8 in which said valve seat of said first packer is removably secured within the upper portion of the central bore of said packer.

14. Apparatus according to claim 13 in which said first packer has internal means for supporting said valve seat within the upper portion of the central bore and set screws through the side wall for securing said valve seat therein.

15. Apparatus according to claim 8 further comprising a retrieving tool assembly for removing said valve closure member from said valve seat of said first packer.

16. Apparatus according to claim 15 in which said retrieving tool assembly comprises a collar locator having connecting means at its top end for connection to a wireline, a quick change coupling connected to the bottom end of said collar locator, a reducing sub connected at its top end to said quick change coupling and at its bottom end to the top of a section of line pipe, said lower portion of said line pipe extending downward and reciprocally received within an elongated tubular outer housing, said outer housing comprising a cylindrical sub having an externally threaded bottom and a plurality of perforations in its side wall, a flat circular plate having a central bore secured to said interior of said sub near said top end and said line pipe slidably received through said central bore, said sub secured to said top of a string of tubing, a valve collar connected to the bottom end of said lowermost section of tubing removably containing a pivotally mounted flapper valve including a valve seat, a piston member attached at said lower end of said line pipe having seals which reciprocally seal on said interior surface of said tubing string, and a grapple member having an upper portion connected to said valve collar and a lower portion depending therefrom and provided with engaging means for engaging the top portion of said movable bore closure member, said piston movable upwardly by said line pipe from a position near said bottom of said lowermost section of tubing to open said flapper valve and draw sand into said interior of said tubing string.

17. Apparatus according to claim 16 in which said grapple member engaging means comprises a series of depending fingers having internal notches on their inner surfaces which engage mating engaging means on said top portion of said movable bore closure member.

* * * * *